US011119522B2

(12) United States Patent
Huang

(10) Patent No.: US 11,119,522 B2
(45) Date of Patent: Sep. 14, 2021

(54) SUBSTRATE BIAS GENERATING CIRCUIT

(71) Applicant: NUVOTON TECHNOLOGY CORPORATION, Hsinchu (TW)

(72) Inventor: Ming-Hsin Huang, Hsinchu (TW)

(73) Assignee: Nuvoton Technology Corporation, Hsinchu (TW)

( * ) Notice: Subject to any disclaimer, the term of this patent is extended or adjusted under 35 U.S.C. 154(b) by 0 days.

(21) Appl. No.: 17/004,899

(22) Filed: Aug. 27, 2020

(65) Prior Publication Data

US 2021/0080991 A1 Mar. 18, 2021

(30) Foreign Application Priority Data

Sep. 18, 2019 (TW) ..... 108133693

(51) Int. Cl.
*G05F 3/20* (2006.01)

(52) U.S. Cl.
CPC ..... *G05F 3/205* (2013.01)

(58) Field of Classification Search
CPC ..... G05F 3/205; G11C 5/146
See application file for complete search history.

(56) References Cited

U.S. PATENT DOCUMENTS 5,834,966 A * 11/1998 So ..... G05F 3/205 327/534
5,929,695 A * 7/1999 Chan ..... G05F 3/205 326/36
6,118,328 A * 9/2000 Morikawa ..... H03K 19/0016 327/534
7,425,845 B2 * 9/2008 Toba ..... G11C 5/147 326/80
7,847,616 B2 * 12/2010 Hashimoto ..... H03K 19/0013 327/534
7,868,667 B2 * 1/2011 Park ..... H03K 19/00323 327/112
8,542,051 B2 * 9/2013 Ogawa ..... H03K 3/35613 327/333
8,742,831 B2 * 6/2014 Fechner ..... G05F 1/46 327/534
9,118,322 B2 * 8/2015 Husain ..... H03K 17/145
9,378,777 B2 * 6/2016 Koyama ..... G11C 5/146
10,324,485 B2 * 6/2019 Huang ..... G05F 3/205
10,411,703 B1 * 9/2019 Tripathi ..... H03K 19/0005
2002/0195623 A1 * 12/2002 Horiuchi ..... H01L 27/1203 257/200

* cited by examiner

*Primary Examiner* — Thomas J. Hiltunen
(74) *Attorney, Agent, or Firm* — Muncy, Geissler, Olds & Lowe, P.C.

(57) ABSTRACT

A substrate bias generating circuit is provided for generating a substrate bias to a body of a transistor of a functional circuit. The substrate bias generating circuit includes a first transistor and a second transistor which are connected in series between a supply voltage terminal and a ground terminal, and control terminals of the first transistor and the second transistor are coupled to each other. A third transistor includes a terminal electrically coupled to body of one of the first transistor and the second transistor, and another terminal coupled to the body. A resistance element is connected between the terminal of the third transistor and a current input terminal of the first transistor or a current output terminal of the second transistor.

7 Claims, 7 Drawing Sheets

SUBSTRATE BIAS GENERATING CIRCUIT

CROSS-REFERENCE TO RELATED APPLICATION

This application claims the benefit of Taiwan Patent Application No. 108133693, filed on Sep. 18, 2019, in the Taiwan Intellectual Property Office, the disclosure of which is incorporated herein in its entirety by reference.

BACKGROUND

1. Field

The invention relates to a substrate bias generating circuit, and more particularly to a substrate bias generating circuit that can supply an appropriate substrate bias as the supply power voltage changes.

2. Description of the Related Art

In recent years, the application of the Internet-of-Things (IoT) has attracted much attention, but there are still key technologies to overcome. For example, the devices used in IoT applications must have extremely low power consumption, which means that the overall circuit must be able to enable normally when the supply power voltage (VDD) is lower than the standard threshold voltage of the transistor. Therefore, what is urgently needed is a substrate bias generating circuit, which can enable the overall circuit to normally activate even at a lower supply voltage, and when the VDD returns to over the standard threshold voltage, the circuit can be returned to the normal operating state under the standard threshold voltage, and as much as possible no leakage current.

SUMMARY

An aspect of the invention is to provide a substrate bias generating circuit, which can provide an appropriate substrate bias when the supply power voltage is lower than the standard threshold voltage of the transistor, so that the threshold voltage of the transistor of the functional circuit is reduced for facilitating to activate the transistor, and when the supply power voltage is greater than the threshold voltage of the transistor, the substrate bias generating circuit of an aspect of the invention provides an appropriate substrate bias to reduce leakage current.

Based on the above purpose, an aspect of the invention provides a substrate bias generating circuit for providing a substrate bias to a body of a transistor of a functional circuit, the substrate bias generating circuit includes a first transistor, a second transistor, a third transistor and a resistance element.

The first transistor and the second transistor are connected in series between a high voltage terminal and a low voltage terminal, and the control terminal of the first transistor is coupled to the control terminal of the second transistor. The control terminals of the first transistor and the second transistor receive an enable signal.

An terminal of the third transistor is electrically coupled to the body of one of the first transistor and the second transistor, and another terminal of the third transistor is coupled to the body of the third transistor, the control terminal of the third transistor receives an disable signal, and the disable signal is the inverted signal of the enable signal.

The resistance element is coupled between the terminal of the third transistor and the current input terminal of the first transistor or the current output terminal of the second transistor. The voltage at the terminal of the third transistor is the substrate bias.

According to an embodiment of the invention, the first transistor is an NMOS transistor, the second transistor is a PMOS transistor, the third transistor is a PMOS transistor, and the terminal of the third transistor is a drain, the drain of the third transistor is electrically coupled to the body of the second transistor, the body of the third transistor is electrically coupled to the source of the third transistor, and the source of the first transistor is coupled to the low voltage terminal or a default bias terminal, the source of the second transistor is coupled to the high voltage terminal.

According to an embodiment of the invention, the two terminals of the resistance element are respectively coupled to the drain of the third transistor and the drain of the second transistor.

According to an embodiment of the invention, the drain of the third transistor and the drain of the second transistor are electrically connected, and the two terminals of the resistance element are respectively coupled to the drain of the third transistor and the drain of the first transistor.

According to an embodiment of the invention, the first transistor is an NMOS transistor, the second transistor is a PMOS transistor, the third transistor is an NMOS transistor, and the terminal of the third transistor is a drain, the drain of the third transistor is electrically coupled to the body of the first transistor, the body of the third transistor is electrically coupled to the drain of the third transistor, and a source of the first transistor is electrically coupled to the low voltage terminal, a source of the second transistor is coupled to the high voltage terminal or a default bias terminal.

According to an embodiment of the invention, the two terminals of the resistance element are respectively coupled to the drain of the third transistor and the drain of the first transistor.

According to an embodiment of the invention, the drain of the third transistor and the drain of the first transistor are electrically connected, and the two terminals of the resistance element are respectively coupled to the drain of the third transistor and the drain of the second transistor.

According to an embodiment of the invention, the high voltage terminal is a supply voltage terminal, and the low voltage terminal is a ground terminal.

DETAILED DESCRIPTION

The embodiment of the invention will be described below in detail with reference to the drawings and examples, so as to fully understand the implementation process of how the invention applies technical means to solve technical problems and achieve technical effects and enablement.

Before describing the technical features of the invention, the definition of related terms will be described first. Hereinafter, the so-called "threshold voltage" of the transistor is the criterion for judging whether the voltage (VGS) between the gate and source of the transistor can turn on the transistor. Taking the NMOS transistor as an example, the threshold voltage is positive, when the voltage between the gate and source of the NMOS transistor is greater than the threshold voltage, the NMOS transistor is turned on. The threshold voltage will change with the voltage of the body of the NMOS transistor. Usually, the body of NMOS transistor is electrically connected to the source and connected to the supply power or grounded, so the threshold voltage is fixed.

The substrate bias generating circuit of the invention is used for providing a substrate bias to a body of a transistor of a functional circuit, so that the functional circuit is in sub-threshold voltage state when the supply voltage is too low, it can still keep higher frequency operation. The substrate bias generating circuit includes a first transistor, a second transistor, a third transistor, and a resistance element.

The first transistor and the second transistor are connected in series between a high voltage terminal and a low voltage terminal. In the following description, the high voltage terminal is the supply voltage terminal VDD as an example, and the low voltage terminal is the ground terminal GND as an example.

The control terminal of the first transistor is coupled to the control terminal of the second transistor. The control terminal of the first transistor and the control terminal of the second transistor receive an enable signal.

A terminal of the third transistor is electrically coupled to the body of one of the first transistor and second transistor, and another terminal of the third transistor is coupled to the body of the third transistor. A control terminal of the third transistor receives a disable signal, and the disable signal is the inverted signal of the enable signal.

The resistance element is coupled between the terminal of the third transistor and a current input terminal of the first transistor or a current output terminal of the second transistor.

Various embodiments of the invention will be described below with multiple aspects.

Figure 1:
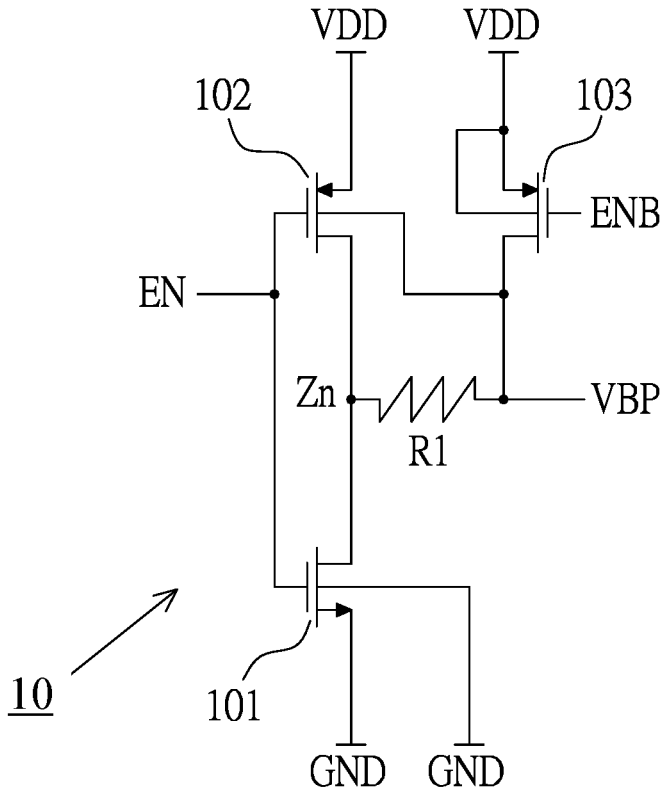
FIG. 1 is showing a circuit diagram of a first embodiment of a substrate bias generating circuit of the invention.

Referring to FIG. 1, which is a circuit diagram of a first embodiment of a substrate bias generating circuit of the invention. In the figure, the transistor included in the substrate bias generating circuit 10 is implemented by a metal oxide semiconductor field effect transistor (MOSFET, hereinafter referred to as MOS transistor), but this is only an example, not a limitation of the invention. The first transistor is an N-type metal oxide semiconductor field effect transistor 101 (hereinafter referred to as NMOS transistor), and the second transistor is a P-type metal oxide semiconductor field effect transistor 102 (hereinafter referred to as PMOS transistor). The third transistor is a PMOS transistor 103, and the body of the PMOS transistor 103 is electrically coupled to the source of the PMOS transistor 103.

The source and the body of the NMOS transistor 101 are coupled to the ground terminal GND, the source of the PMOS transistor 102 and the source of the PMOS transistor 103 are coupled to the supply voltage terminal VDD, and the body of the PMOS transistor 102 is coupled to the drain of the PMOS transistor 103. The two terminals of the resistance element R1 are respectively coupled to the drain of the PMOS transistor 103, the drain of the NMOS transistor 101, and the drain of the PMOS transistor 102. The drain of the PMOS transistor 103 is coupled to the body of the transistor of a functional circuit, so the voltage VBP on the drain of the PMOS transistor 103 is provided to the functional circuit as a substrate bias.

The gate of the NMOS transistor 101 and the gate of the PMOS transistor 102 receive an enable signal EN, and the gate of the PMOS transistor 103 receives a disable signal ENB. The disable signal ENB is an inverted signal of the enable signal EN. When the enable signal EN is at a high voltage level, the substrate bias generating circuit of the invention can be activated.

Figure 2:
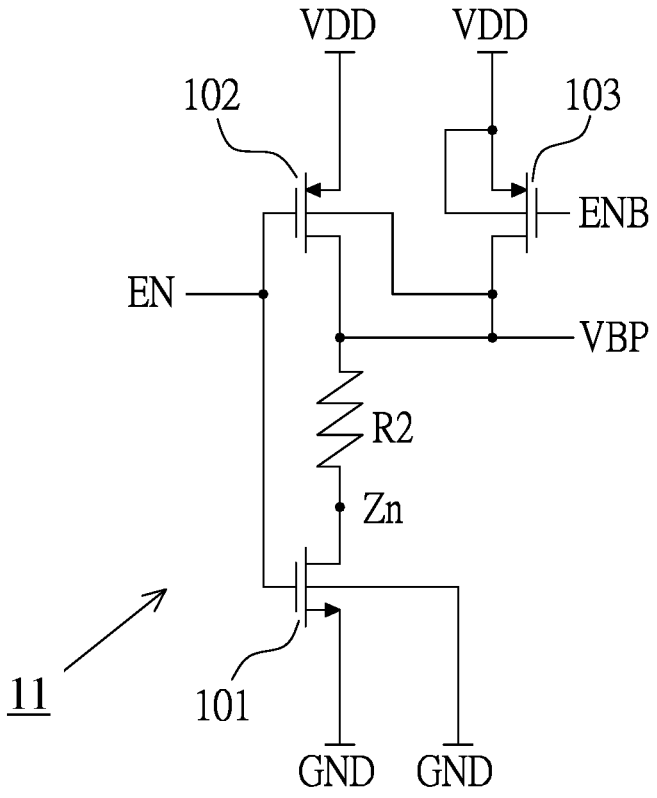
FIG. 2 is showing a circuit diagram of a second embodiment of the substrate bias generating circuit of the invention.

Referring to FIG. 2, which illustrates a circuit diagram of a second embodiment of the substrate bias generating circuit of the invention. The second embodiment differs from the above-described embodiment in the connection method of the resistance element. In the embodiment of FIG. 2, the drain of the PMOS transistor 103 and the drain of the PMOS transistor 102 are electrically connected, and the two terminals of the resistance element R2 are respectively coupled to the drain of the PMOS transistor 103 and the drain of the NMOS transistor 101.

Figure 3:
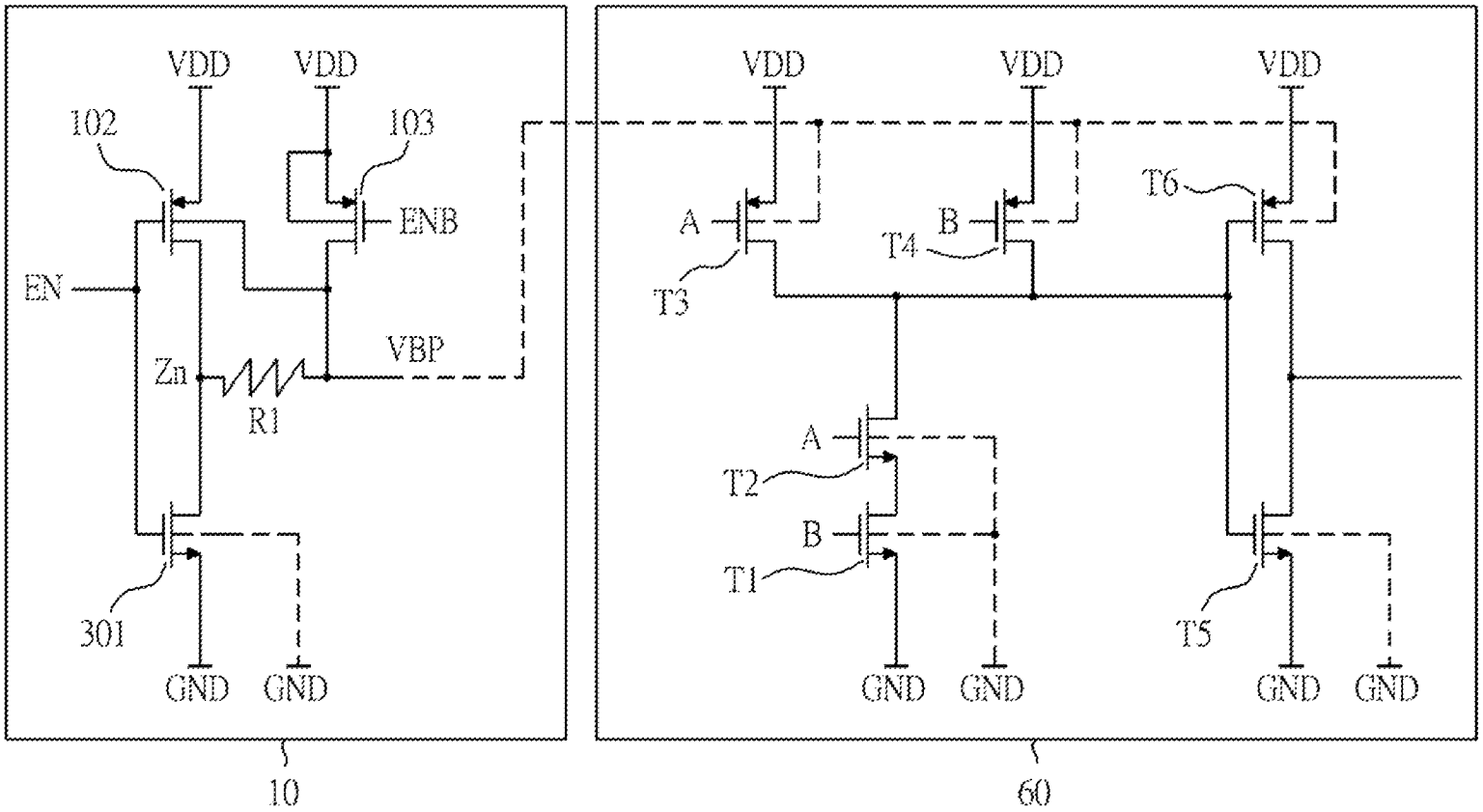
FIG. 3 is showing a schematic diagram that a first embodiment of the substrate bias generating circuit of the invention is applied to a functional circuit.

Referring to FIG. 3, which illustrates a schematic diagram that a first embodiment of the substrate bias generating circuit of the invention is applied to a functional circuit. In FIG. 3, the functional circuit 60 is a logic operation circuit, which is a combination of a NAND circuit and a NOT circuit. However, this is only an example, not a limitation of the invention. In other embodiments, the functional circuit 60 may be any type of circuit. The substrate bias generating circuit 10 outputs a substrate bias VBP to the bodies of the PMOS transistor T3, PMOS transistor T4 and PMOS transistor T6 of the functional circuit 60, and the bodies of the NMOS transistor T1, NMOS transistor T2 and NMOS transistor T5 of the functional circuit 60 are coupled to the ground terminal GND.

When the enable signal EN is at a high voltage level (high) and the disable signal ENB is at a low voltage level (low), the NMOS transistor 101 is turned on, and the terminal Zn potential is zero. After the circuit is powered on, the voltage of the supply voltage terminal VDD starts to rise from 0V. Therefore, the voltage of the supply voltage terminal VDD is less than the threshold voltage of the PMOS transistor 103 at the beginning, so the PMOS transistor 103 is only weakly turned on or even in the off state (cut-off state), so the voltage across the resistance element R1 will only be related to the leakage current of the PMOS transistor 103, the leakage current of the PMOS transistor 103 flows through the resistance element R1 to the ground terminal GND via the NMOS transistor 101.

When the voltage of the supply voltage terminal VDD gradually rises but is still less than the threshold voltage of the PMOS transistor 103, the leakage current of the PMOS transistor 103 is positive correlation to the voltage of the supply voltage terminal VDD. Therefore, in the initial stage after the circuit is powered on, the substrate bias VBP is proportional to the voltage at the supply voltage terminal VDD, but is almost equal to zero.

For example, when the voltage of the supply voltage terminal VDD is too small, for example, 0.3V, the PMOS transistor 103 is turned off, and the substrate bias VBP is almost equal to zero. The sources of the PMOS transistor T3, PMOS transistor T4, and PMOS transistor T6 of the functional circuit 60 receive the voltage of the supply voltage terminal VDD and the bodies of the PMOS transistor T3, PMOS transistor T4, and PMOS transistor T6 receive the substrate bias VBP, so when the substrate bias VBP is kept close to zero voltage and the voltage of the supply voltage terminal VDD rises continuously, the substrate bias will cause the threshold voltages of PMOS transistor T3, PMOS transistor T4 and PMOS transistor T6 to decrease. The technique that the threshold voltage of the transistor changes with the substrate bias is well known to person skilled in the art, and will not be repeated here.

Compared to the case where the bodies of the PMOS transistor T3, PMOS transistor T4, and PMOS transistor T6 are connected to their sources and the threshold voltages are almost kept at a fixed value, the substrate bias generating circuit of the invention provides the substrate bias VBP, which can lower the threshold voltages of the PMOS transistor T3, PMOS transistor T4, and PMOS transistor T6 during the initial stage of voltage rising of the supply voltage terminal VDD, so that the substrate bias VBP is able to cause the PMOS transistor T3, PMOS transistor T4, and PMOS transistor T6 to turn on earlier.

After the PMOS transistor T3, PMOS transistor T4 and PMOS transistor T6 are turned on, their operating frequencies become higher. When the voltage of the supply voltage terminal VDD is lower than the threshold voltage, the function circuit 60 can only operate at a lower frequency. When the adjusted threshold voltage is lower than the voltage of the supply voltage terminal VDD, the function circuit 60 can operate at a higher frequency. Therefore, the substrate bias generating circuit of the invention allows the functional circuit 60 to operate at a higher frequency earlier, which helps to improve the efficiency of the functional circuit 60.

Next, when the voltage of the supply voltage terminal VDD is higher than the threshold voltage, the PMOS transistor 103 is fully turned on, the substrate bias VBP is equal to the voltage of the supply voltage terminal VDD, so that the PMOS transistor T3, PMOS transistor T4 and PMOS transistor T6 of the functional circuit 60 are changed to the normal connection manner, that is, the source and the body are at the same potential, thereby avoiding leakage current. In addition, the PMOS transistor 103 and the PMOS transistor of the functional circuit 60 receiving the substrate bias are the same type and manufactured by the same process, the substrate bias generating circuit of the invention will generate a suitable level of voltage at the same temperature condition, so that temperature and process effects can be ignored.

When the enable signal EN is at a low potential and the disable signal ENB is at a high potential, the substrate bias generating circuit 10 is turned off. When the enable signal EN is at a low potential, the PMOS transistor 102 is turned on and the NMOS transistor 101 is turned off. At the same time, the disable signal ENB is at a high potential, and the PMOS transistor 103 is turned off Therefore, the terminal Zn is connected to the supply voltage terminal VDD from the PMOS transistor 102, that is, the substrate bias VBP is the voltage of the supply voltage terminal VDD, so that no leakage path is generated when the substrate bias generating circuit 10 is turned off.

The above-mentioned circuit operation process is explained by the substrate bias generating circuit 10. Similarly, the substrate bias generating circuit 11 of FIG. 2 also provides the substrate bias VBP in the same manner to change the threshold voltage of the transistor of the functional circuit. After the circuit is powered on, the voltage of the supply voltage terminal VDD starts to rise from 0V. Therefore, in the initial stage and when the enable signal EN is at a high potential and the disable signal ENB is at a low potential, the PMOS transistor 103 is only weakly turned on or even in the cut-off state, the leakage current of the PMOS transistor 103 flows through the resistance element R2 and flows to the ground terminal GND via the NMOS transistor 101.

Therefore, the cross-voltage generated on the resistance element R2 is only related with the PMOS transistor 103, and the leakage current of PMOS transistor 103 is positively related to the voltage of the supply voltage terminal VDD. When the voltage of the supply voltage terminal VDD is greater than the threshold voltage, the PMOS transistor 103 is fully turned on, so that the substrate bias VBP is equal to the voltage of the supply voltage terminal VDD.

Figure 4:
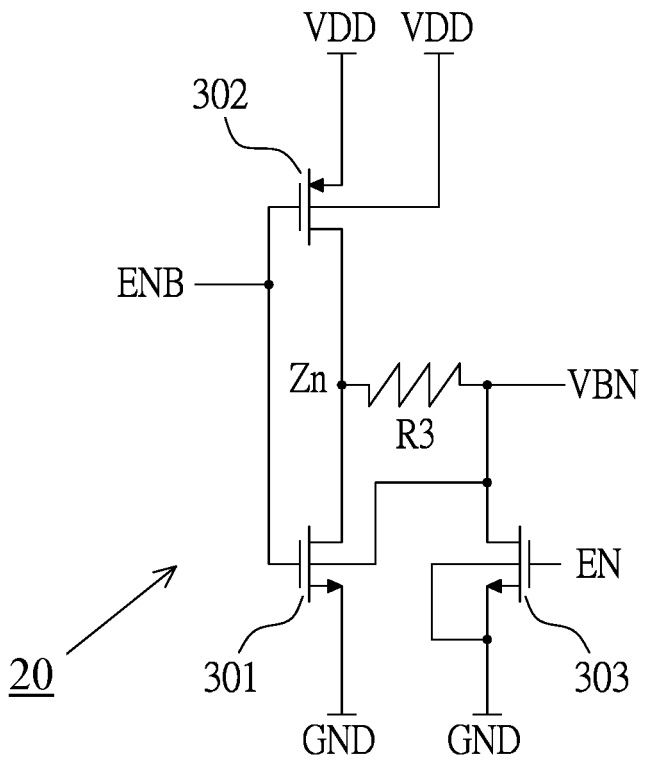
FIG. 4 is showing a circuit diagram of a third embodiment of the substrate bias generating circuit of the invention.

Referring to FIG. 4, which is a circuit diagram of a third embodiment of the substrate bias generating circuit of the invention. In the figure, in the substrate bias generating circuit 20, the first transistor is an NMOS transistor 301, the second transistor is a PMOS transistor 302, and the third transistor is an NMOS transistor 303. The body and the source of the NMOS transistor 303 are electrically coupled to the ground terminal GND.

The source of the NMOS transistor 301 is coupled to the ground terminal GND, the body of the NMOS transistor 301 is coupled to the drain of the NMOS transistor 303, the source and the body of the PMOS transistor 302 are coupled to the supply voltage terminal VDD, and the drain of the PMOS transistor 302 is coupled to the drain of NMOS transistor 301. The two terminals of the resistance element R3 are respectively coupled to the drain of the NMOS transistor 303 and the drain of the NMOS transistor 301. The drain of the NMOS transistor 303 is coupled to the body of the transistor of the functional circuit, whereby the voltage VBN on the drain of the NMOS transistor 303 is provided to the functional circuit as a substrate bias.

The gate of the NMOS transistor 301 and the gate of the PMOS transistor 302 receive the disable signal ENB, and a gate of the NMOS transistor 303 receives the enable signal EN. The disable signal ENB is an inverted signal of the enable signal EN. When the enable signal EN is at a high voltage level, the substrate bias generating circuit of the invention can be activated.

Figure 5:
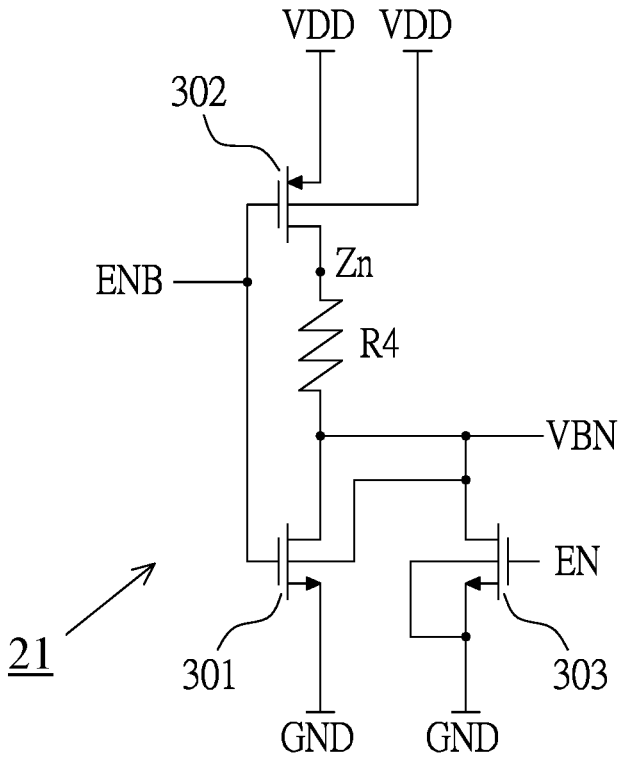
FIG. 5 is showing a circuit diagram of a fourth embodiment of the substrate bias generating circuit of the invention.

Referring to FIG. 5, which is a circuit diagram of a fourth embodiment of the substrate bias generating circuit of the invention. The fourth embodiment of the substrate bias generating circuit 21 is different from the third embodiment in the connection manner of the resistance element. In the embodiment of FIG. 5, the drain of the NMOS transistor 303 and the drain of the NMOS transistor 301 are electrically connected, and the two terminals of the resistance element R4 are respectively coupled to the drain of the NMOS transistor 303 and the drain of the PMOS transistor 302.

Figure 6:
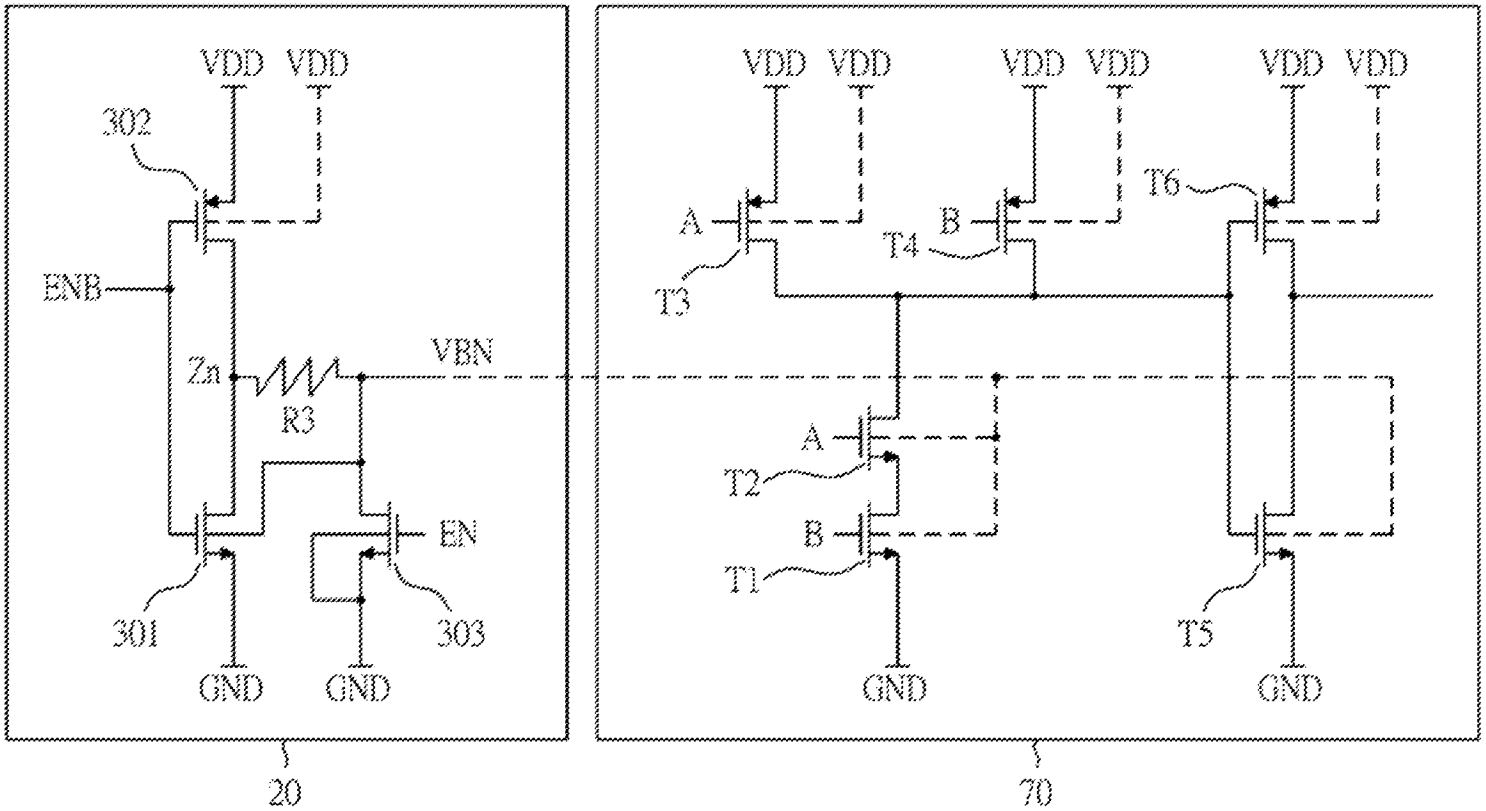
FIG. 6 is showing a schematic diagram that a third embodiment of the substrate bias generating circuit of the invention is applied to a functional circuit.

Please refer to FIG. 6, which illustrates a schematic diagram that a third embodiment of the substrate bias generating circuit of the invention is applied to a functional circuit. As shown in FIG. 6, the substrate bias generating circuit 20 outputs the substrate bias VBN to the bodies of the NMOS transistor T1, NMOS transistor T2, and NMOS transistor T5 of the functional circuit 70.

When the enable signal EN is at a high voltage level and the disable signal ENB is at a low voltage level, and the voltage of the supply voltage terminal VDD is lower than the threshold voltage of the PMOS transistor 302, the PMOS transistor 302 is only weakly turned on or even in the cut-off state, so that the cross-voltage generated on the resistance element R3 is related to the leakage current of the NMOS transistor 303.

Since the leakage current is small, the substrate bias VBN is almost equal to the voltage of the supply voltage terminal VDD. Since the sources of the NMOS transistor T1, NMOS transistor T2, and NMOS transistor T5 of the functional circuit 70 are grounded and the bodies of the NMOS transistor T1, NMOS transistor T2, and NMOS transistor T5 receive the substrate bias VBN that is almost equal to the voltage of the supply voltage terminal VDD, the threshold voltages of the NMOS transistor T1, NMOS transistor T2, and NMOS transistor T5 are reduced, so that the continuously-rising voltage of the supply voltage terminal VDD can be higher than the adjusted threshold voltages earlier, to make the NMOS transistor T1, NMOS transistor T2, and NMOS transistor T5 turned on earlier, whereby operating at a higher frequency.

Next, when the voltage of the supply voltage terminal VDD rises continuously to be higher than the original threshold voltage of the transistor, the NMOS transistor 303 is fully turned on, the substrate bias VBN is equal to zero, so that the NMOS transistor T1, NMOS transistor T2 and NMOS transistor T5 of functional circuit 60 are changed to the normal connection manner, that is, the source and the body are at the same potential, thereby avoiding leakage current. In addition, the NMOS transistor 303 and the NMOS transistor of the functional circuit 60 receiving the substrate bias are the same type and manufactured by the same process, so that the substrate bias generating circuit of the invention can generate a suitable level of voltage at the same temperature, and temperature and process effects can be ignored.

When the enable signal EN is at a low potential and the disable signal ENB is at a high potential, the substrate bias generating circuit 20 is turned off. When the disable signal ENB is at a high potential, the PMOS transistor 302 is turned off and the NMOS transistor 301 is turned on; at the same time, the enable signal EN is at a low potential and the NMOS transistor 303 is turned off. Therefore, the terminal Zn is grounded via the NMOS transistor 301, that is, the substrate bias VBN is zero. As a result, no leakage path is generated when the substrate bias generating circuit 20 is turned off.

The above circuit operation process is explained by the substrate bias generating circuit 20. Similarly, the substrate bias generating circuit 21 of FIG. 6 also provides the substrate bias VBN in the same manner to change the threshold voltage of the transistor of the functional circuit, so it will not repeat here.

Figure 7:
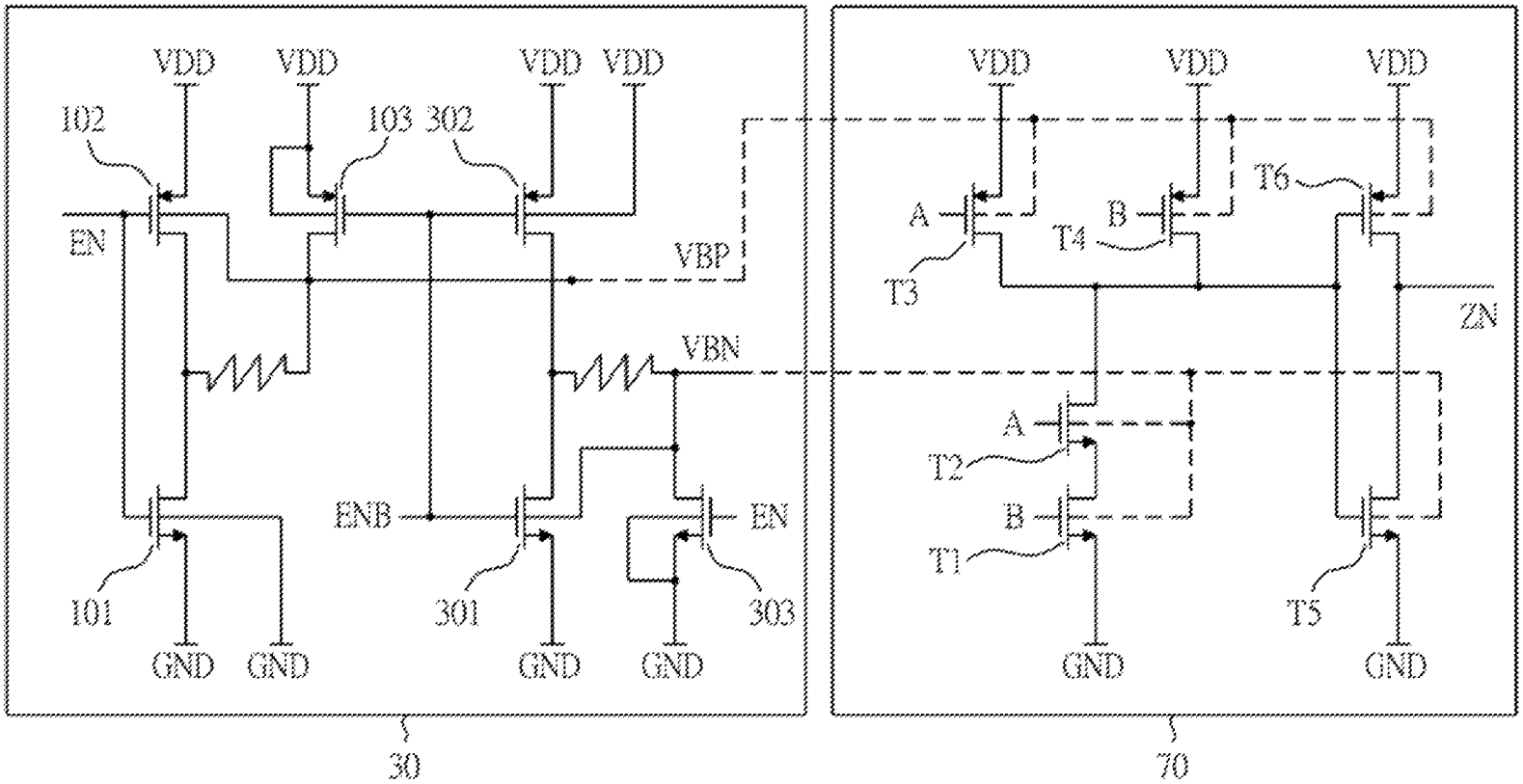
FIG. 7 is showing a schematic diagram that a fifth embodiment of the substrate bias generating circuit of the invention is applied to a functional circuit.

Referring to FIG. 7, which is a schematic diagram that a fifth embodiment of the substrate bias generating circuit of the invention is applied to a functional circuit. As shown in FIG. 7, the fifth embodiment of the substrate bias generating circuit 30 is a combination of the substrate bias generating circuit 10 or the substrate bias generating circuit 11 and the substrate bias generating circuit 20 or the substrate bias generating circuit 21. In this manner, the substrate bias VBP can be provided to the transistor T3, transistor T4 and transistor T6 of the functional circuit 80, and the substrate bias VBN can be provided to the transistor T1, transistor T2 and transistor T5 of the functional circuit 80 at the same time. The operation manner of the substrate bias generating circuit 30 is the same as that of the above-mentioned substrate bias generating circuit, so it will not repeat here.

Although the invention is disclosed with the foregoing embodiments as above, it is not intended to limit the invention. A person skilled in the arts can make some modifications and retouching without departing from the spirit and scope of the invention. The patent protection scope of the invention shall be determined by the scope of the patent application claims attached to the specification.

What is claimed is:

1. A substrate bias generating circuit for providing a substrate bias to a body of a transistor of a functional circuit, comprising:

a first transistor and a second transistor, connected in series between a high voltage terminal and a low voltage terminal, wherein a control terminal of the first transistor is coupled to a control terminal of the second transistor, and the control terminals of the first transistor and the second transistor are configured to receive an enable signal;

a third transistor, wherein a terminal of the third transistor is electrically coupled to a body of one of the first transistor and the second transistor, and another terminal of the third transistor is coupled to a body of the third transistor, and a control terminal of the third transistor receives a disable signal, and the disable signal is an inverted signal of the enable signal; and a resistance element, coupled between the terminal of the third transistor and one of a current input terminal of the first transistor and a current output terminal of the second transistor;

wherein a voltage of the terminal of the third transistor is the substrate bias;

wherein the first transistor is a NMOS transistor, the second transistor is a PMOS transistor, the third transistor is a PMOS transistor, and the terminal of the third transistor is a drain, the drain of the third transistor is electrically coupled to the body of the second transistor, the body of the third transistor is electrically coupled to a source of the third transistor, and a source of the first transistor is coupled to one of the low voltage terminal and a default bias terminal, and a source of the second transistor is coupled to the high voltage terminal.

2. The substrate bias generating circuit of claim 1, wherein two terminals of the resistance element are respectively coupled between the source of the third transistor and a drain of the second transistor.

3. The substrate bias generating circuit of claim 1, wherein the drain of the third transistor and a drain of the second transistor are electrically connected, and two terminals of the resistance element are respectively coupled between the drain of the third transistor and a drain of the first transistor.

4. A substrate bias generating circuit for providing a substrate bias to a body of a transistor of a functional circuit, comprising:

a first transistor and a second transistor, connected in series between a high voltage terminal and a low voltage terminal, wherein a control terminal of the first transistor is coupled to a control terminal of the second transistor, and the control terminals of the first transistor and the second transistor are configured to receive an enable signal;

a third transistor, wherein a terminal of the third transistor is electrically coupled to a body of one of the first transistor and the second transistor, and another terminal of the third transistor is coupled to a body of the third transistor, and a control terminal of the third transistor receives a disable signal, and the disable signal is an inverted signal of the enable signal; and a resistance element, coupled between the terminal of the third transistor and one of a current input terminal of the first transistor and a current output terminal of the second transistor;

wherein a voltage of the terminal of the third transistor is the substrate bias;

wherein the first transistor is a NMOS transistor, the second transistor is a PMOS transistor, the third transistor is a PMOS transistor, and the terminal of the third transistor is a drain, the drain of the third transistor is electrically coupled to the body of the first transistor, a body of the third transistor is electrically coupled to the drain of the third transistor, and a source of the first transistor is electrically coupled to the low voltage terminal, and a source of the second transistor is connected to one of the high voltage terminal and a default bias terminal.

5. The substrate bias generating circuit of claim 4, wherein two terminals of the resistance element are respectively coupled between the drain of the third transistor and a drain of the first transistor.

6. The substrate bias generating circuit of claim 4, wherein the drain of the third transistor and a drain of the first transistor are electrically connected, and two terminals of the resistance element are respectively coupled between the drain of the third transistor and a drain of the second transistor.

7. The substrate bias generating circuit of claim 4, wherein the high voltage terminal is a supply voltage terminal and the low voltage terminal is a ground terminal.

* * * * *